United States Patent [19]

Matsuda

[11] 4,312,771

[45] Jan. 26, 1982

[54] VISCOUS LIQUID SOAP COMPOSITION

[75] Inventor: Noboru Matsuda, Joyo, Japan

[73] Assignee: Duskin Franchise Co., Ltd., Osaka, Japan

[21] Appl. No.: 233,454

[22] Filed: Feb. 11, 1981

[30] Foreign Application Priority Data

Dec. 26, 1980 [JP] Japan ..... 55/183801

[51] Int. Cl.[3] ..... C11D 9/26; C11D 10/04; C11D 17/08

[52] U.S. Cl. ..... 252/107; 252/108; 252/117; 252/118; 252/122; 252/173; 252/DIG. 14

[58] Field of Search ..... 252/107, 108, 117, 118, 252/122, DIG. 14, 173

[56] References Cited

U.S. PATENT DOCUMENTS

| | | | |
|---|---|---|---|
| 2,089,305 | 8/1937 | Stickdorn | 252/118 |
| 2,093,928 | 9/1937 | Preston | 252/109 |
| 2,527,076 | 10/1950 | Preston | 252/117 |
| 2,792,347 | 5/1957 | Stegemeyer | 252/108 |
| 3,723,328 | 3/1973 | Pelizza | 252/111 |
| 3,808,156 | 4/1974 | Gorsich | 252/545 |
| 4,058,473 | 11/1977 | Canter | 252/122 X |
| 4,260,528 | 4/1981 | Fox | 252/525 |
| 4,268,262 | 5/1981 | Bechstedt | 252/122 X |

*Primary Examiner*—Dennis L. Albrecht
*Attorney, Agent, or Firm*—Sherman & Shalloway

[57] ABSTRACT

Disclosed is a viscous liquid soap composition which comprises 8 to 11 parts by weight, per 100 parts by weight of the total composition, of a potassium oleate soap, and 3.5 to 5.5 parts by weight, per 100 parts by weight of the total composition, of a higher saturated fatty acid potassium soap, and then the total amount of said two soaps being 13.5 to 15.5 parts by weight per 100 parts by weight of the total composition, 5 to 7 parts by weight, per 100 parts by weight of the total composition, of a fatty acid monoethanolamide and 9 to 11 parts by weight, per 100 parts by weight of the total composition, of a polyhydric alcohol selected from the group consisting of propylene glycol and glycerin, with the remainder being water.

This soap composition has such a viscosity-temperature correlation that the viscosity is highest at room temperature or at a temperature in close proximity to room temperature. Furthermore, in this soap composition, the viscosity is hardly changed with the lapse of time.

7 Claims, 2 Drawing Figures

VISCOUS LIQUID SOAP COMPOSITION

BACKGROUND OF THE INVENTION (1) Field of the Invention

The present invention relates to a liquid soap composition. More particularly, the present invention relates to a viscous liquid soap composition which is contained in a dispenser in a toilet and used for washing hands.

(2) Description of the Prior Art

A liquid soap which is contained in a dispenser in a toilet or the like and is used for washing hands is ordinarily desired to have an appropriate viscosity, for example 500 to 2500 cps. A liquid soap having such a high viscosity is in the form of a soft cream suitable for the use, and such liquid soap can be prevented from falling down through between fingers when it is placed on hands. Furthermore, when such liquid soap is discharged from the dispenser onto the palm, splashing of the soap is not caused.

In known viscous liquid soap compositions of this type, the viscosity is adjusted to a certain level by incorporating a viscosity increaser such as polyethylene glycol monostearate into an aqueous solution of a soap. In such liquid soap, however, the viscosity increaser which has no direct relation to the washing action has to be incorporated, and at low temperatures, the viscosity of the liquid soap is drastically increased. Furthermore, during the storage, the viscosity increaser is degraded with the lapse of time by hydrolysis or the like, with the result that the viscosity-increasing effect is gradually lost. Accordingly, known viscous liquid soap compositions are still insufficient in various points.

SUMMARY OF THE INVENTION

I found that when predetermined amounts of an fatty acid monoethanolamide and a specific polyhydric alcohol are combined with a specific soap base containing a potassium oleate soap in a specific amount, even without incorporation of any particular viscosity increaser, there can be obtained a liquid soap composition having such a viscosity-temperature correlation that the viscosity is highest at room temperature or at a temperature in close proximity to room temperature. It also was found that this liquid soap composition was excellent in the stability at low temperatures and the viscosity of the soap composition was hardly changed with the lapse of time.

It is therefore a primary object of the present invention to provide a liquid soap composition having a novel viscosity-temperature correlation such that the viscosity is highest at room temperature or at a temperature in close proximity to room temperature.

Another object of the present invention is to provide a liquid soap composition in which the viscosity-increasing effect can be attained only by components effective for washing without incorporation of any particular viscosity increaser.

Still another object of the present invention is to provide a liquid soap composition which is excellent in the stability at low temperatures and in which the viscosity is hardly changed with the lapse of time.

In accordance with the present invention, there is provided a viscous liquid soap composition which comprises 8 to 11 parts by weight, per 100 parts by weight of the total composition, of a potassium oleate soap, and 3.5 to 5.5 parts by weight, per 100 parts by weight of the total composition, of a higher saturated fatty acid potassium soap, and then the total amount of said two soaps being 13.5 to 15.5 parts by weight per 100 parts by weight of the total composition, 5 to 7 parts by weight, per 100 parts by weight of the total composition, of a fatty acid monoethanolamide and 9 to 11 parts by weight, per 100 parts by weight of the total composition, of a polyhydric alcohol selected from the group consisting of propylene glycol and glycerin, with the remainder being water.

DETAILED DESCRIPTION OF THE PREFERRED EMBODIMENTS

The liquid soap composition of the present invention has a novel unexpected viscosity temperature correlation such that the viscosity is highest at room temperature or at a temperature in close proximity to room temperature, especially 5° to 25° C.

Ordinary liquids and solutions have such a viscosity-temperature correlation that the viscosity is high at low temperatures but the viscosity is low at high temperatures. Certain aqueous sols have a reverse viscosity-temperature correlation such that the viscosity is low at low temperatures but the viscosity is high at high temperatures.

Figure 1:
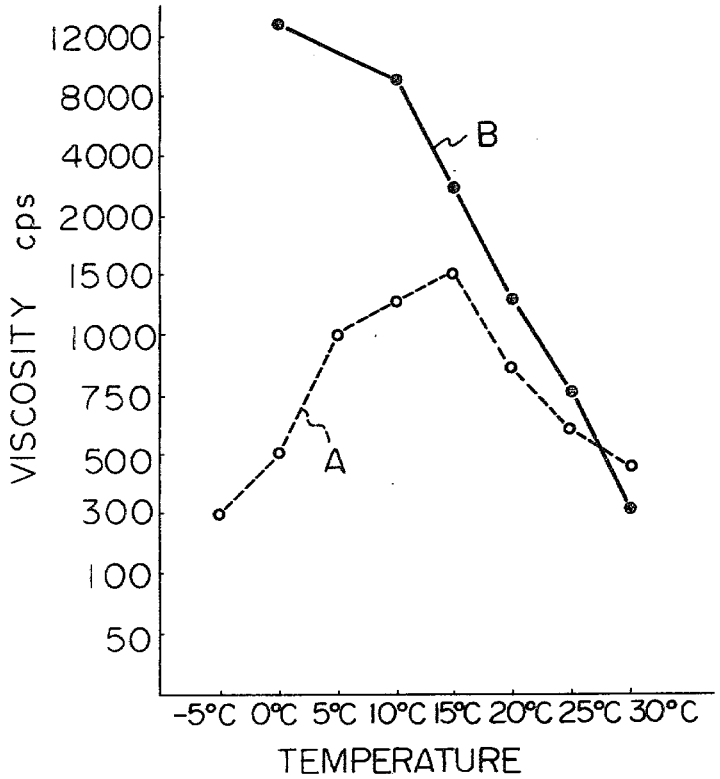
FIG. 1 is a graph illustrating the viscosity-temperature correlation of a liquid soap composition of the present invention (curve A) and a viscosity increaser-incorporated liquid soap composition (curve B).

Curve B of FIG. 1 of the accompanying drawings shows the viscosity-temperature correlation of a known viscosity increaser-incorporated liquid soap composition. As is seen from this curve, in this known composition, the viscosity is at a satisfactory level at room temperature, but as the temperature is lowered, the viscosity is drastically increased and the stability of the liquid soap is lost. In contrast, as shown by curve A in FIG. 1, the liquid soap of the present invention has a peak of the viscosity at room temperature or at a temperature in close proximity to room temperature, and if the temperature is elevated or lowered from this peak temperature, the viscosity rather tends to reduce. Therefore, the liquid soap of the present invention has at room temperature an appropriate viscosity suitable for handling, and even at low temperatures, a good stability of the liquid soap can be maintained because the viscosity is rather lowered. Furthermore, when the liquid soap is placed on hands and rubbed by the hands, the viscosity is lowered by the body temperature and the spreading property of the soap is enhanced, with the result that a good washing effect can be obtained.

Ordinarily, the liquid soap of the present invention has a viscosity of 500 to 2500 cps at 15° C.

The reason why the liquid soap of the present invention has the above-mentioned novel viscosity-temperature correlation has not completely been elucidated. However, it is believed that the liquid soap of the present invention having the above-mentioned specific composition has both the properties of a solution and the properties of a sol and that the properties of a solution are predominant at temperatures exceeding a certain critical temperature while the properties of a sol are predominant at temperatures lower than this critical temperature, and it is presumed that at this certain critical temperature, the viscosity is highest.

In addition to the above-mentioned peculiar viscosity-temperature correlation, the liquid soap of the present invention has the following unexpected advantageous property.

Figure 2:
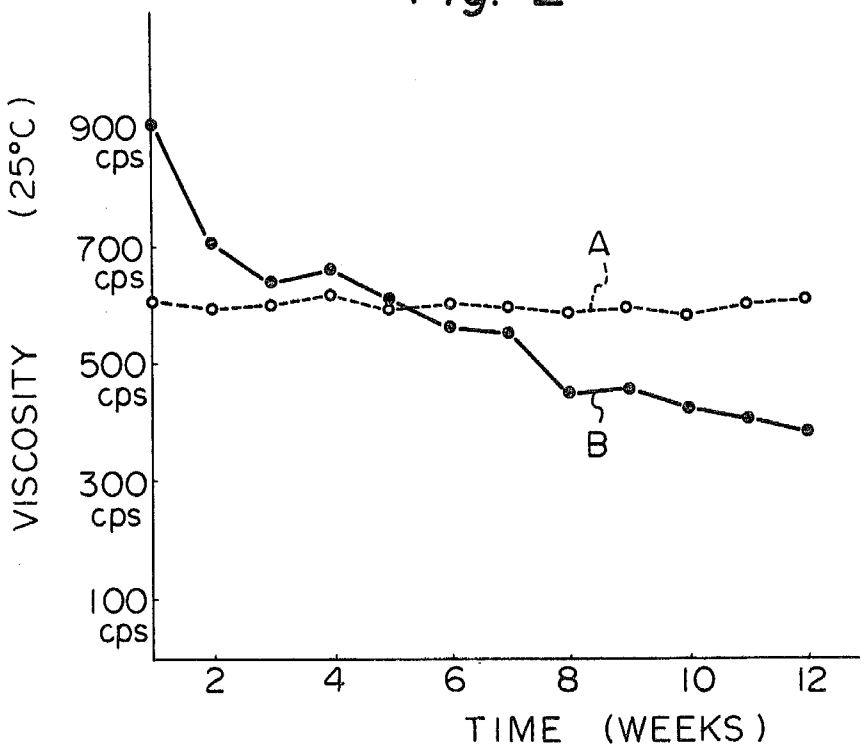
FIG. 2 is a graph illustrating the viscosity-time correlation of a liquid soap composition according to the present invention (curve A) and a viscosity increaser-incorporated liquid soap composition (curve B).

In a known viscosity increaser-incorporated liquid soap, as is seen from curve B of FIG. 2, the viscosity is drastically reduced with the lapse of time. In contrast, in the liquid soap of the present invention, as is seen from curve A of FIG. 2, such reduction of the viscosity with the lapse of time is hardly observed, and the intended viscosity-increasing effect can be maintained very stably in the liquid soap of the present invention.

In the present invention, it is indispensable that a potassium oleate soap should be selected as a part of the soap base and be used in combination with a higher saturated fatty acid potassium soap. If this requirement is not satisfied, a liquid soap having the above-mentioned viscosity characteristics cannot be obtained. As the higher saturated fatty acid potassium soap, there can be used, for example, a potassium stearate soap, a potassium palmitate soap and a potassium laurate soap and mixed fatty acid soaps such as a beef-tallow fatty acid potassium soap and a coconut fatty acid potassium soap. Among these potassium soaps, a coconut fatty acid potassium soap is especially preferred.

In the present invention, in order to obtain a liquid soap having the above-mentioned viscosity-temperature correlation, it also is important that the potassium oleate soap should be used in an amount of 8 to 11 parts by weight of the total liquid soap (all of "parts by weight" given hereinafter are based on 100 parts by weight of the total liquid soap unless otherwise indicated) and the higher saturated fatty acid potassium soap should be used in an amount of 3.5 to 5.5 parts by weight, and that the total amount of said two soaps should be 13.5 to 15.5 parts by weight. A liquid soap comprising the above-mentioned two potassium soaps in the above-mentioned amounts is hardly irritating to the skin and is excellent in the washing property.

The liquid soap of the present invention comprises, in addition to the above-mentioned soap components, 5 to 7 parts by weight of a fatty acid monoethanolamide. This component exerts a peculiar function of increasing the viscosity at room temperature or at a temperature in close proximity to room temperature. As the fatty acid monoethanolamide, there can be used, for example, monoethanolamides derived from saturated and unsaturated fatty acids having 14 to 18 carbon atoms, preferably lauric acid, palmitic acid, stearic acid and oleic acid.

In order to improve the stability of the liquid soap at low temperatures, it is important that at least one polyhydric alcohol selected from the group consisting of propylene glycol and glycerin should be incorporated. The polyhydric alcohol is used in an amount of 9 to 11 parts by weight. It is ordinarily preferred that propylene glycol and glycerin be used at a weight ratio of from 7/3 to 3/7, especially from 6/4 to 4/6.

In the liquid soap composition of the present invention, known additives or assistants may be incorporated according to known recipes. For example, a water-soluble chelating agent such as a polyamine-carboxylic acid, e.g., disodium ethylene-diamine tetraacetate, or citric acid may be incorporated as a stabilizer in an amount of 0.01 to 1.0 part by weight, and a fungicide or disinfectant such as 3-methyl-4-isopropyl phenol may be incorporated in an amount of 0.05 to 1.0 part by weight. Furthermore, minute amounts of a coloring material and a perfume may be incorporated. Moreover, in order to impart a pearl effect to the liquid soap, a pearling agent such as polyethylene glycol monostearate or a magnesium salt of a higher fatty acid may be incorporated in an amount of 0.5 to 5 parts by weight.

The present invention will now be described in detail with reference to the following examples that by no means limit the scope of the invention.

EXAMPLE 1

A liquid soap (A) was prepared according to the following recipe.

| | |
|---|---|
| Potassium oleate soap | 10 parts by weight |
| Coconut fatty acid potassium soap | 4.5 parts by weight |
| Coconut fatty acid ethanolamide | 6 parts by weight |
| Propylene glycol | 5.5 parts by weight |
| Glycerin | 5 parts by weight |
| 3-methyl-4-isopropyl phenol (fungicide) | 0.5 part by weight |
| Ethylene glycol monostearate (pearling agent) | 1 part by weight |
| Coloring material (Rhodamine B) | 0.0001 part by weight |
| Perfume (Lemongrass Oil) | 0.1 part by weight |

Water was added so that the total amount was 100 parts by weight.

A comparative liquid soap (B) was prepared according to the following recipe.

| | |
|---|---|
| Coconut fatty acid potassium soap | 10 parts by weight |
| Polyethylene glycol monostearate (viscosity increaser) | 6 parts by weight |
| 3-Methyl-4-isopropyl phenol (fungicide) | 0.5 part by weight |
| Genapol PGM Conc. (pearling agent) | 2.5 parts by weight |
| Coloring material (Rhodamine B) | minute amount |
| Perfume (Lemongrass Oil) | 0.1 part by weight |

Water was added so that the total amount was 100 parts by weight.

The temperature-viscosity correlations of the above liquid soaps (A) and (B) were determined to obtain results shown in FIG. 1. These liquid soaps were allowed to stand still at room temperature over a period of 12 weeks, and the viscosities of the liquid soaps were measured at 25° C. during this period to obtain results shown in FIG. 2.

EXAMPLE 2

Liquid soaps were prepared in the same manner as described in example 1 by using soap bases, washing assistants, wetting agents and stabilizers shown in Table 1. These liquid soaps were subjected to the tests described below to obtain results shown in Table 1.

VISCOSITY

The viscosity was measured at 25° C. by using a B-type viscometer, and the viscosity was expressed in the centipoise unit (cps).

HIGH TEMPERATURE STABILITY

The liquid soap was allowed to stand still at 50° C. for one week. The sample which was in the state of a homogeneous and stable liquid after standing was indicated by mark "⊙". The sample in which crystals were roughened and the liquid was slightly unstable was indicated by mark "○". The sample in which precipitation was caused and the liquid was unstable was indicated by mark "●".

LOW TEMPERATURE STABILITY

The liquid soap was allowed to stand still at −5° C. for one week, and the stability of the liquid soap was examined. The sample in which the fluentness was not lost after standing and the liquid was kept stable was indicated by mark "⊙". The sample in which the fluentness was considerably reduced was indicated by mark "○". The sample in which the fluentness was completely lost was indicated by mark "●".

STANDING TEST

The liquid soap was allowed to stand still for 3 months, and the stability was evaluated according to the same standard as described above with respect to the high temperature stability.

WATER-RETAINING PROPERTY OF LIQUID SURFACE

The liquid soap was charged in a dispenser and allowed to stand at room temperature for 20 days, and the water-retaining property of the air-contacting surface was examined. The sample in which no film was formed on the liquid face was indicated by mark "⊙". The sample in which a thin film was formed on the liquid face was indicated by mark "○". The sample in which a considerably thick film was formed on the liquid face was indicated by mark "●".

pH VALUE

The pH value was measured at 25° C. by using a glass electrode pH meter.

From the results shown in Table 1, it will readily be understood that if the components specified in the present invention are incorporated in amounts specified in the present invention, there can be obtained liquid soaps which are satisfactory in various points.

Notes: The rating of the results in Table 1 are presented as follows:

⊙: excellent
○: good
●: poor.

TABLE 1

| Components | Recipe No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Soaps | | | | | | | | | | | | | | |
| potassium oleate soap | 9.6 | 7 | 12 | 9.6 | 10 | 10 | 10 | 10 | 10 | 10 | 10 | 10 | 12 | 12 |
| coconut fatty acid potassium soap | 5.0 | 3.6 | 3.6 | 5.0 | 4.5 | 4.5 | 4.5 | 4.5 | 4.5 | 4.5 | 4.5 | 4.5 | 9 | 9 |
| beef-tallow fatty acid potassium soap | | | | | | | | | | | | | | |
| Assistants | | | | | | | | | | | | | | |
| coconut fatty acid monoethanolamide | 6.0 | 6.0 | 7.0 | | 4.0 | 8.0 | 6.0 | 6.5 | 6.0 | 6.0 | 3.0 | 10.0 | 6.0 | 6.0 |
| coconut fatty acid diethanolamide | | | | 7.0 | | | | | | | | | | |
| Wetting Agents | | | | | | | | | | | | | | |
| propylene glycol | 5.0 | 5.0 | 5.0 | 5.0 | 5.0 | 5.0 | 6.0 | 6.0 | 5.5 | 5.0 | 3.0 | 5.0 | 15.0 | 15.0 |
| glycerin | 5.5 | 6.0 | 4.0 | 5.0 | 5.0 | 5.0 | 6.0 | 5.0 | 5.0 | 5.0 | 3.0 | 3.0 | | |
| sorbitol | | | | | | | | | | | | | 30 | 20 |
| Other Components | | | | | | | | | | | | | | |
| disodium ethylene-diamine tetraacetate | 0.1 | 0.1 | 0.1 | 0.1 | 0.1 | 0.1 | 0.1 | 0.1 | 0.1 | 0.1 | 0.1 | 0.1 | 0.1 | 0.1 |
| polyethylene glycol monostearate | 1.0 | 1.0 | 1.0 | 1.0 | 1.0 | 1.0 | 1.0 | 1.0 | 1.0 | 1.0 | 1.0 | 1.0 | 1.0 | 1.0 |
| 3-methyl-4-isopropyl phenol | 0.1 | 0.1 | 0.1 | 0.1 | 0.5 | 0.5 | 0.5 | 0.5 | 0.5 | 0.5 | 0.5 | 0.5 | 0.1 | 0.1 |
| coloring material (Rhodamine B) | minute amount | minute amount | minute amount | minute amount | minute amount | minute amount | minute amount | minute amount | minute amount | minute amount | minute amount | minute amount | minute amount | minute amount |
| perfume (Lemongrass Oil) | minute amount | minute amount | minute amount | minute amount | minute amount | minute amount | minute amount | minute amount | minute amount | minute amount | minute amount | minute amount | minute amount | minute amount |
| Results | | | | | | | | | | | | | | |
| viscosity (25°) (cps) | 600 | 1600 | 2500 | 150 | 250 | 300 | 200 | 500 | 600 | 800 | 150 | 250 | 400 | 200 |
| high temperature stability | ◎ | ◎ | ◎ | ○ | ● | ● | ● | ◎ | ◎ | ◎ | ● | ● | ◎ | ◎ |
| low temperature stability | ◎ | ● | ● (frozen) | ◎ | ◎ | ◎ | ◎ | ◎ | ◎ | ◎ | ● | ◎ | ○ | ● |
| standing test | ◎ | ◎ | ◎ | ◎ | ◎ | ◎ | ◎ | ◎ | ◎ | ◎ | ● | ◎ | ● | ● |
| water-retaining property of liquid surface | ◎ | ◎ | ○ | ◎ | ◎ | ◎ | ◎ | ◎ | ◎ | ◎ | ● | ◎ | ● | ● |
| pH value | 9.5 | 9.5 | 9.6 | 9.5 | 9.6 | 9.6 | 9.6 | 9.6 | 9.6 | 9.6 | 9.6 | 9.6 | 9.6 | 9.5 |

What is claimed is:

1. A viscous liquid soap composition having a viscosity of 500 to 2500 cps measured at 15° C. and a viscosity-temperature correlation such that the viscosity is highest at room temperature or a temperature in close proximity to room temperature, said composition comprising 8 to 11 parts by weight, per 100 parts by weight of the total composition, of a potassium oleate soap, and 3.5 to 5.5 parts by weight, per 100 parts by weight of the total composition, of a higher saturated fatty acid potassium soap, and the total amount of said two soaps being 13.5 to 15.5 parts by weight per 100 parts by weight of the total composition, 5 to 7 parts by weight, per 100 parts by weight of the total composition, of a fatty acid monoethanolamide and 9 to 11 parts by weight, per 100 parts by weight of the total composition, of at least one polyhydric alcohol selected from the group consisting of propylene glycol and glycerin, with the remainder being water.

2. A liquid soap composition as set forth in claim 1, which further comprises small amounts of a fungicide, a pearling agent, a coloring material and a perfume.

3. A liquid soap composition as set forth in claim 1 wherein said higher saturated fatty acid potassium soap is selected from the group consisting of potassium stearate soap, potassium palmitate soap, potassium laurate soap, beef-tallow fatty acid potassium soap and coconut fatty acid potassium soap.

4. A liquid soap composition as set forth in claim 1 wherein said higher saturated fatty acid potassium soap is coconut fatty acid potassium soap.

5. A viscous liquid soap composition as set forth in claim 1 wherein said fatty acid monoethanolamide is selected from the group consisting of lauric acid monoethanolamide, palmitic acid monoethanolamide, stearic acid monoethanolamide and oleic acid monoethanolamide.

6. A liquid soap composition as set forth in claim 1 wherein said polyhydric alcohol comprises a mixture of propylene glycol and glycerin at a weight ratio of from 7/3 to 3/7.

7. A liquid soad composition as set forth in claim 1 comprising:

| | |
|---|---|
| Potassium oleate soap | 10 parts by weight |
| Coconut fatty acid potassium soap | 4.5 parts by weight |
| Coconut fatty acid ethanolamide | 6 parts by weight |
| Propylene glycol | 5.5 parts by weight |
| Glycerin | 5 parts by weight |
| Fungicide | 0.5 parts by weight |
| Pearling agent | 1 part by weight |
| Coloring material | 0.0001 part by weight |
| Perfume | 0.1 part by weight |
| Water | to make 100 parts by weight. |

* * * * *